United States Patent [19]

Armstrong et al.

[11] Patent Number: 4,771,149

[45] **Date of Patent: * Sep. 13, 1988**

[54] COMPACT ROTARY SWITCH

[76] Inventors: L. Lamar Armstrong; Peter Medicks, both of 525 Truck La., P.O. Box 860, Smithfield, N.C. 27577

[ * ] Notice: The portion of the term of this patent subsequent to Mar. 22, 2005 has been disclaimed.

[21] Appl. No.: 47,909

[22] Filed: May 8, 1987

Related U.S. Application Data

[63] Continuation-in-part of Ser. No. 3,609, Jan. 15, 1987, Pat. No. 4,733,034.

[51] Int. Cl.[4] ..... H01H 19/04

[52] U.S. Cl. ..... 200/336; 200/155 R

[58] Field of Search ..... 200/336, 291, 155 R; 74/527

[56] References Cited

U.S. PATENT DOCUMENTS 2,817,721 12/1957 Edwards ..... 200/291

*Primary Examiner*—Renee S. Luebke

*Attorney, Agent, or Firm*—Rhodes, Coats & Bennett

[57] ABSTRACT

An indexing mechanism for a rotary switch includes a bushing having a plurality of longitudinal serrations on the inner bearing surface. A rotatable shaft having a transversely extending opening herein is journaled within the bushing. A catch element is disposed within the transverse opening in the rotatable shaft and projects therefrom to engage the serrations on the inner bearing surface.

1 Claim, 4 Drawing Sheets

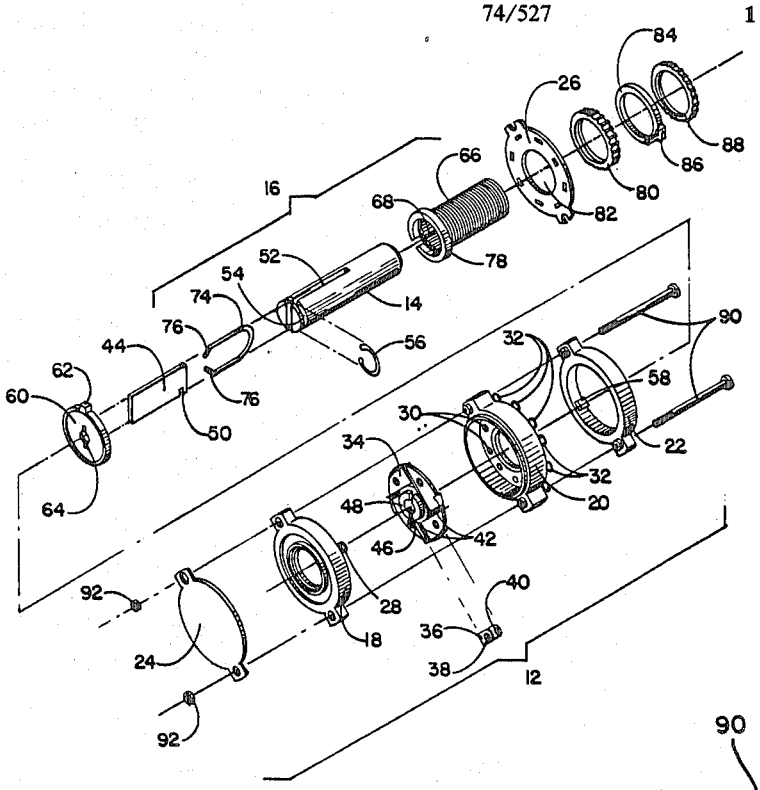

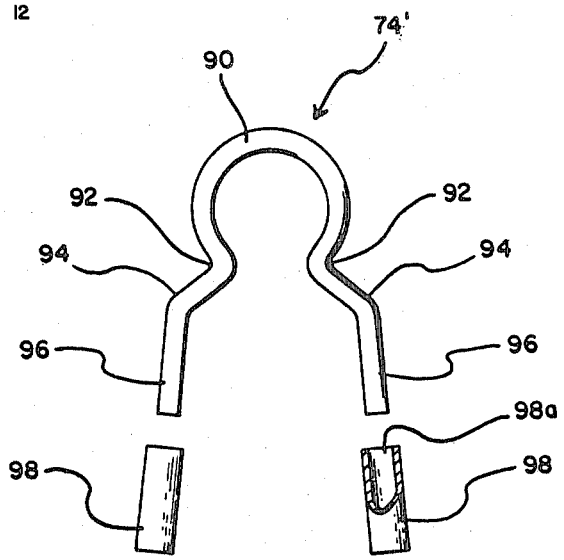

COMPACT ROTARY SWITCH

This is a continuation-in-part patent application of patent application Ser. No. 003,609 filed Jan. 15, 1987, now U.S. Pat. No. 4,733,034.

FIELD OF THE INVENTION

The invention relates generally to rotary switches and more particularly to indexing mechanisms therefor to station the switch components at incremental positions.

BACKGROUND OF THE INVENTION

The movement towards miniaturization in the electronics industry has brought about a need for more compact electronic components including switches. In rotary switches having distinct switch positions, existing detents or indexing mechanisms render the switch too large and bulky for many applications. Typical detent or indexing mechanisms are disposed between the bushing which serves as a bearing for the switch shaft and the switch components thereby increasing the size and length of the switch. The patents to Guenther et al (U.S. Pat. No. 4,490,588) and Ohashi et al (U.S. Pat. No. 4,527,023) are representative of typical detenting mechanisms used in rotary switches. The patents to Edwards (U.S. Pat. No. 2,817,721) and Diehl (U.S. Pat. No. 3,712,151) also disclose indexing mechanisms.

In an effort to downsize rotary switches, many manufacturers have begun using smaller switch components to offset the size of the detent and indexing mechanism. While attaining the desired result of a smaller switch, the performance and electrical characteristics of the switch are adversely affected. A more promising approach which does not affect the electrical performance of a switch is to decrease the size and space requirements of the detent and indexing mechanism. However, the reliability and accuracy of the indexing mechanism can be affected.

SUMMARY AND OBJECTS OF THE INVENTION

The present invention avoids the disadvantages of prior art rotary switches by employing the bushing, which serves as a bearing for the switch shaft, as part of the detent and indexing mechanism. A plurality of longitudinal serrations including a plurality of tooth-like projections separated by a plurality of notches or grooves extend through the bushings. The upper portion of each tooth-like projection serves as a bearing surface for a shaft which is rotatively journaled in the bushing. The shaft includes a transverse opening in which a catch element is disposed. The catch element is biased to project from the opening in the shaft and to seat within one of the notches forming a part of the serrated bearing surface. As the shaft is rotated, the catch element rides over the tooth-like projections into the next notch to provide an indexing mechanism for stationing the shaft at incremental positions.

Accordingly, it is a primary object of the present invention to provide a compact rotary switch having incremental switch positions without affecting the performance or electrical characteristics of the switch.

Another object of the present invention is to provide a detent or indexing mechanism for a rotary switch which does not increase the size or length of the switch.

Another object of the present invention is to provide a compact rotary switch wherein the detent or indexing mechanism is housed within the bushing which serves as a bearing for the switch shaft.

Another object of the present invention is a compact rotary switch wherein the bushing serves simultaneously as a bearing for the switch shaft, as a means for mounting the switch on a panel, and as part of a detent or indexing mechanism.

Another object of the present invention is to provide a compact rotary switch with a high mechanical strength and a long useful life.

Other objects and advantages of the present invention will become apparent and obvious from a study of the following description and the accompanying drawings which are merely illustrative of such invention.

DETAILED DESCRIPTION OF THE INVENTION

Figure 1:
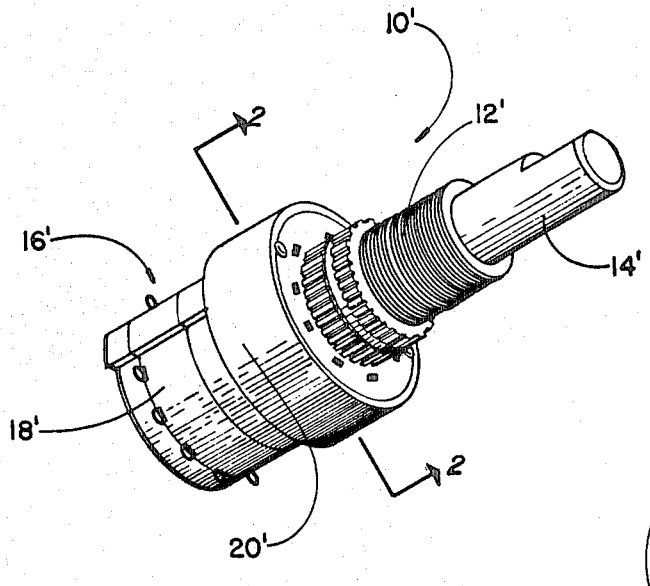
Prior Art FIG. 1
FIG. 1 is a perspective view of a prior art rotary switch.
Figure 2:
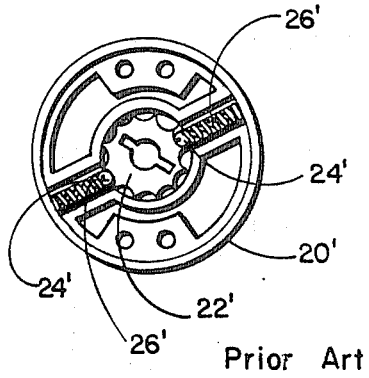
Prior Art FIG. 2
FIG. 2 is a section view of a prior art rotary switch taken through line 2—2 of FIG. 1 showing a detent or indexing mechanism thereof.

Referring first to FIGS. 1 and 2 of the drawings, a prior art rotary switch is shown therein and indicated generally by the numeral 10'. The prior art switch includes a threaded bushing 12' which serves as a bearing for shaft 14', as well as a means for mounting switch 10' in a panel. Bushing 12' is mounted on a switch housing 16' comprising a lower housing 18' which houses the electrical components of the switch and an upper housing 20' which houses the detent or indexing mechanism of the switch.

A typical detent or indexing mechanism is illustrated in FIG. 2. The indexing mechanism shown includes a star wheel 22' which rotates with shaft 14'. A pair of detent balls 24' are pressed against the star wheel 22' by springs 26' to accurately position the switch at selected increments. The detent or indexing mechanism described consumes a relatively large amount of space when compared to the total size of the switch 10'. Obviously, it is desirable to decrease the space requirement of the detent or indexing mechanism.

The present invention achieves a substantial size reduction of the switch without affecting its electrical characteristics by relocating the detent or indexing mechanism in the bushing and using components already present in the switch as part of the indexing mechanism. For instance, the bushing serves not only as a bearing for the shaft, but also as part of the detent or indexing mechanism. Nevertheless, the present invention uses the same standard bushings and shafts used in prior art devices.

Figure 3:
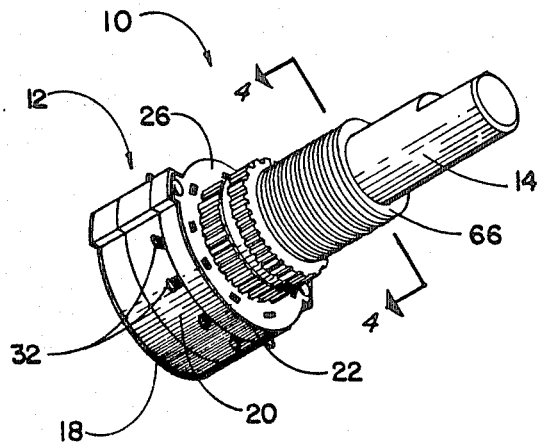
FIG. 3 is a perspective view of the rotary switch of the present invention.
Figure 4:
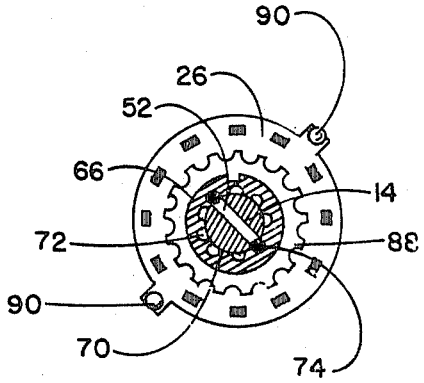
FIG. 4 is a section view thereof taken through line 4—4 of FIG. 3 showing the detent or indexing mechanism thereof.
Figure 5:
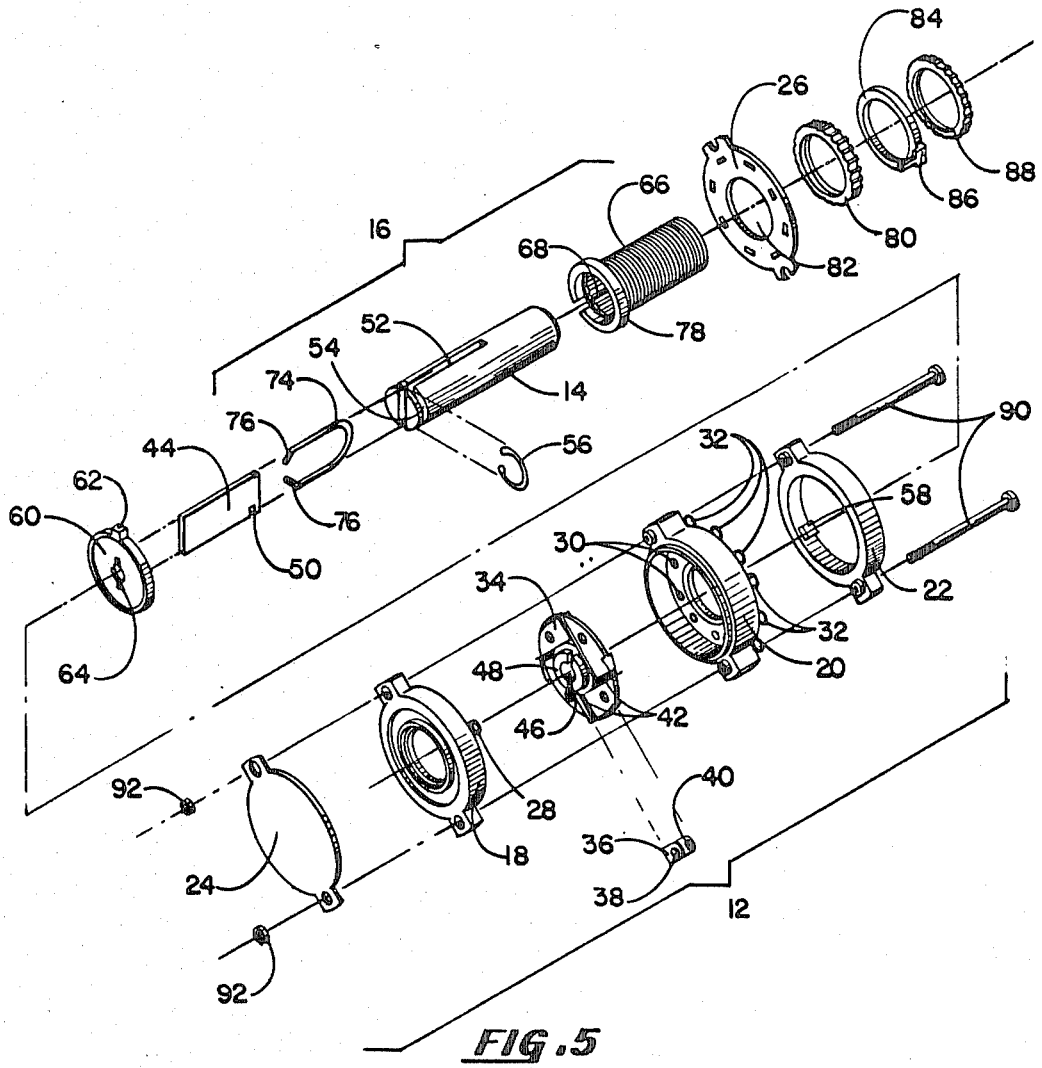
FIG. 5 is an exploded perspective of the rotary switch of the present invention.

Referring now to FIGS. 3 through 5 the compact rotary switch of the present invention is shown therein and indicated generally by the numeral 10. Rotary switch 10 includes a switch assembly indicated generally at 12, a rotatable shaft 14 for selectively positioning the switch assembly 12, and a detent or indexing mechanism indicated generally at 16 for accurately stationing the shaft 14 at incremental positions.

The switch assembly 12 is a conventional rotary type switching mechanism which is well-known to those skilled in the art. In the embodiment shown, a switch housing comprising three separable housing sections 18, 20 and 22 is employed. The housing sections are formed with a dielectric such as plastic by an injection molding process. Additionally, the switch housing includes a rear marking plate 24 and a cover plate 26 which are constructed of stainless steel.

A circular common plate (not shown) having a projecting ground terminal 28 is secured within the lower housing section 18. A plurality of fixed contacts 30 are imbedded in the top of housing section 20 and are connected to stator terminals 32 which are circumferentially spaced and project from the periphery of housing section 20. A rotor 34 is employed to selectively establish an electrical connection between one or more of the fixed contacts 30 and the common plate. The rotor carries at least one U-shaped rotor contact arm 36 having a pair of contacts, 38 and 40, on opposite ends thereof. The rotor contact arm 36 slides edgewise into a respective slot 42 formed in the edge of rotor 34 so that contacts 38 and 40 are disposed on opposite sides of rotor 34.

The rotor contact arm 36 resiliently presses contact 38 against the common plate while pressing contact 40 against the top of housing section 20 in which the fixed contacts 30 are imbedded. As rotor 34 is turned contact 38 remains in contact with the common plate irrespective of the angular position of the rotor 34 while contact 40 sequentially and incrementally engages the fixed contacts 30. Each time a fixed contact 30 is engaged, an electrical connection is established between that contact 30 and the common plate through the electrically conductive rotor contact arm 36.

The rotor 34 is connected to shaft 14 by means of a flat key plate 44. A slotted opening 46 is formed in the hub 48 of rotor 34 to receive one end of the key plate 44. The opposite end of the key plate 44 is notched as indicated at 50. The notched end of key plate 44 extends into a slot 52 formed in one end of shaft 14, which extends approximately half the length of shaft 14. An annular groove 54 extends around the slotted end of shaft 14. The notch 50 aligns with the annular groove 54. A retaining ring 56 snaps into the annular groove 54 to secure the key plate 44. Thus, it is appreciated that rotor 34 rotates with shaft 14.

The switch assembly 12 shown in FIG. 5 also includes a stop mechanism to limit the travel of the switch. A key 58 is formed on the inner surface of housing section 22. A rotor 60 is disposed within housing section 22 and includes a projecting stop element 62. Rotor 60 has a slotted opening 64 through which key plate 44 extends so that rotor 60 rotates with shaft 14. As shaft 14 is rotated, the stop element 62 engages key 58 to limit the travel of the entire rotating assembly. The travel of the switch can be further limited by means of a thrust washer 88 which will be described in detail below.

The switch components are assembled and secured by a pair of bolts 90 which extend through the switch housing. A pair of hex nuts 92 are provided to screw onto respective bolts 90.

Referring now to the indexing mechanism 16, it is seen that the same includes an externally threaded bushing 66 having an inner serrated bearing surface 68. The serrations extends longitudinally through bushing 66 and comprises a plurality of tooth-like projections 70 separated by notches or grooves 72. The upper portion of each tooth-like projection 70 serves as a bearing surface for shaft 14 which is rotatively journaled within bushing 66.

As previously discussed, shaft 14 has a slot 52 extending from one end thereof. A generally U-shaped spring 74 with ends that are bent slightly inward is disposed within slot 52. The spring 74 is biased to urge the arms 76 thereof outwardly and to seat the same in diametrically opposed grooves 72 on the inner bearing surface. As shaft 14 is rotated, the inclined walls of grooves 72 compress the arms 76 of spring 74 which ride over the tooth-like projections 70 into the next groove 72 thereby stopping the rotation of shaft 14 at incremental positions. The grooves 72 must, of course, be precisely aligned with the fixed contacts 30 so that at each stop an electrical connection is established between at least one of the fixed contacts 30 and the ground plate.

Bushing 66 is secured to cover plate 26 by means of a ring 78 secured to one end of bushing 66 and nut 80 which screws onto bushing 66. More particularly, bushing 66 is inserted through an opening 82 in cover plate 26 until ring 78 engages the underside of the cover plate 26. Nut 80 is then secured onto bushing 66 until the same engages the top side of cover plate 26. An optional thrust washer 84 having a pin-like member 86 is inserted over bushing 66 and is secured by a second nut 88. Pin-like member 86 extends through one of 12 openings in cover plate 26 into housing member 22 and serves as a stop to further limit the travel of switch 10 as earlier suggested.

Figure 6:
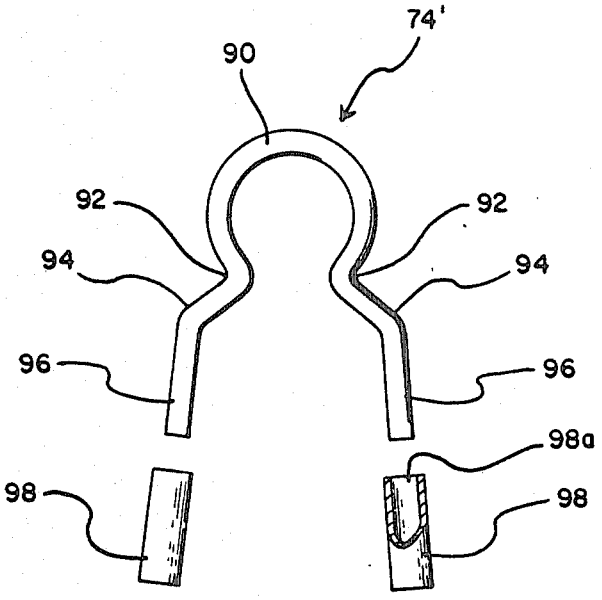
FIG. 6 is an elevation view showing the spring and bearings used to detent the switch.

In a second embodiment of the present invention, the configuration of the spring 74 is designed so that it will center itself within slot 52. Referring to FIG. 6, the self-centering spring 74' includes a head 90, neck 92, shoulders 94, and resilent arms 96; all formed from a single piece of spring steel having a circular cross section. To form the head 90, the spring steel is bent to form a substantial portion of a circle. The spring steel is then turned outwardly to form the neck 92 and shoulders 94 and downwardly to form the arms 96. A pair of stainless steel roller bearings 98 are rotatably mounted on respective arms 96 of spring 74'. The bearings 98 include an axial opening **98*a* through which the arms 96** extend.

Figure 8:
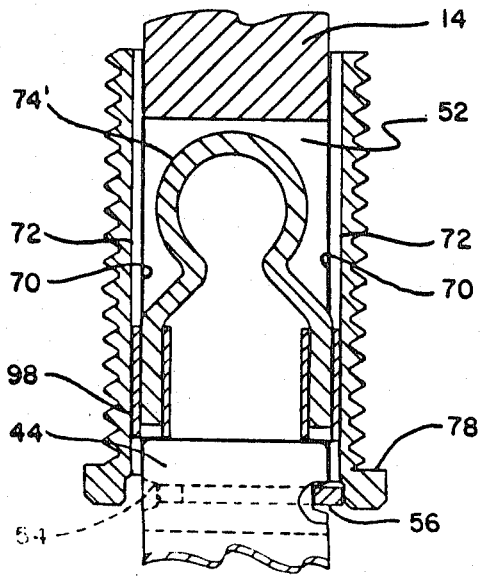
FIG. 8 is a section view taken through line 8—8 of FIG. 7 showing the detent mechanism.

It is appreciated that the width of the spring 74' is slightly greater than the diameter of shaft 14 so that the arms 96 thereof must be compressed in order to insert the spring 74' and shaft 14 into bushing 66. Thus, the arms 96 are constantly urged against the inner bearing surface 68 of bushing 66. The spring 74' is captured between the top of slot 52 and the flat plate 44 as clearly shown in FIGS. 8 and 10. Some slight vertical movement is allowed, however, to help lubricate the bearings 98.

Figure 7:
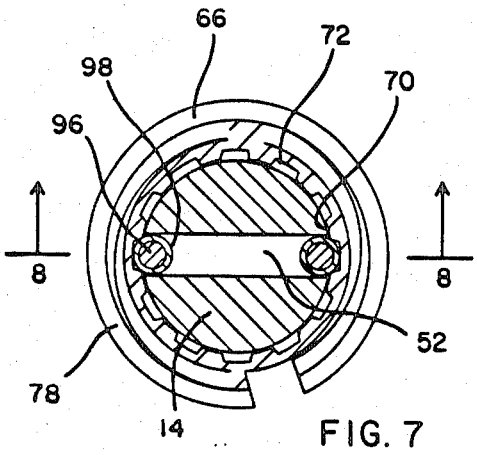
FIG. 7 is a section view taken through the externally threaded bushing of the switch showing the detent mechanism.
Figure 9:
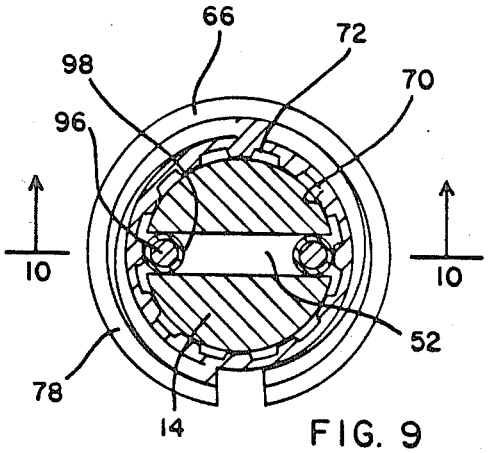
FIG. 9 is a section view taken through the externally threaded bushing of the switch showing the detent mechanism.
Figure 10:
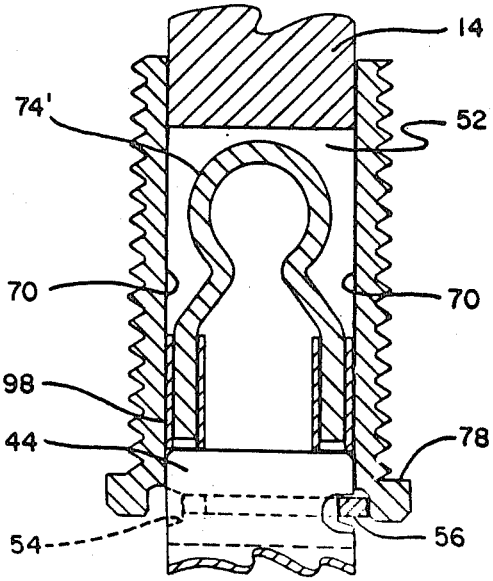
FIG. 10 is a section view taken through line 10—10 of FIG. 9 showing the detent mechanism.

Self-centering spring 74' operates in substantially the same manner as the generally U-shaped spring 74 of the first embodiment. As the shaft 14 is rotated, the tooth-like projections 70 of the serrated bearing surface 68 compress the arms 96 of the spring 74' (FIGS. 9 & 10). The arms ride over the tooth-like projections 70 into the next adjacent groove 72 (FIGS. 7 & 8) to yieldably station the shaft 14 at incremental angles of rotation. The cylindrical bearings 98 rotate about their respective arms 96 as shaft 14 is rotated resulting in a substantial reduction in the amount of drag produced by spring 74'.

Figure 11:
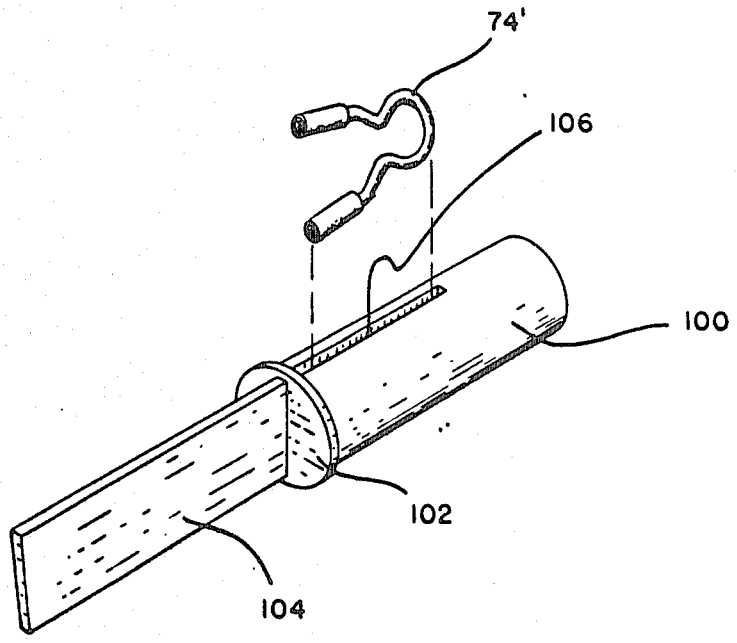
FIG. 11 is a perspective view of a modified shaft assembly.
Figure 12:
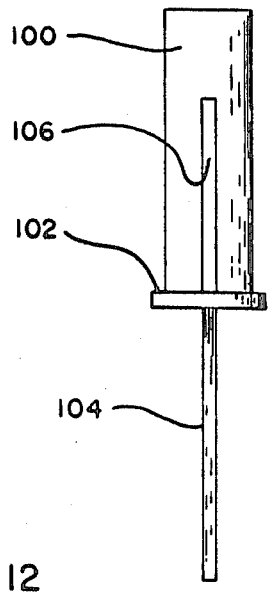
FIG. 12 is an elevation view of the modified shaft assembly.

Referring now to FIGS. 11 and 12, a combination shaft 100 is shown. The combination shaft 100 includes an integrally formed collar 102 and key plate 104, all formed from a dielectric such as plastic. The shaft 100, of course, includes the usual slot 106 for receiving spring 74'. The combination shaft 100 replaces the shaft 14, retaining ring 56, and key plate 44 which form a part of the first and second embodiments. The combination shaft 100 has the advantage of being able to independently size the key plate 104 and slotted opening 106 allowing more freedom in the selection and sizing of components, such as spring 74'. The integral shaft 100 and key plate 104 also facilitates ease of manufacturing.

From the foregoing, it is apparent that the rotary switch of the present invention achieves a significant size reduction without affecting the electrical performance of the switch by relocating the detent or indexing mechanism in the bushing which simultaneously serves to bear the switch shaft. Further, the detent mechanism of the second embodiment provides a greater degree of reliability and an increased life expectancy when compared to similar mechanisms not having bearings. Moreover, the second embodiment achieves a substantial reduction in the amount of drag produced which otherwise would result from the action of spring 74' against the inner bearing surface 68.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A compact rotary switch comprising:

a. a switch housing;

b. a switch assembly disposed within said housing and rotatable about an axis of rotation;

c. an externally threaded bushing for mounting said switch to a panel, said bushing being mounted on said switch housing and centered about said axis of rotation, said bushing including an inner serrated bearing surface having a plurality of circumferentially spaced grooves;

d. a shaft rotatively journaled within said bushing for rotating said switch assembly, said shaft having a slot-like opening formed therein which aligns with the circumferentially spaced grooves in said inner bearing surface; and e. spring means disposed within said slot-like opening in said shaft for yieldably stationing said shaft at incremental angles of rotation, said spring means including a pair of outwardly biased arms, each said arm having a cylindrical roller bearing rotatively mounted thereon which engages and seats within said circumferentially spaced grooves in said inner serrated bearing surface.

* * * * *